US008998276B2

(12) United States Patent
Booth et al.

(10) Patent No.: US 8,998,276 B2
(45) Date of Patent: Apr. 7, 2015

(54) LATCHING SYSTEM FOR STORAGE UNIT

(75) Inventors: Kevin Everett Booth, Mapleton, UT (US); Richard Karl Bowles, West Jordan, UT (US)

(73) Assignee: Penco Products, Inc., Greenville, NC (US)

( * ) Notice: Subject to any disclaimer, the term of this patent is extended or adjusted under 35 U.S.C. 154(b) by 740 days.

(21) Appl. No.: 13/268,199

(22) Filed: Oct. 7, 2011

(65) Prior Publication Data

US 2013/0088133 A1 Apr. 11, 2013

(51) Int. Cl.
*E05B 17/00* (2006.01)
*A47B 47/02* (2006.01)
*E05B 15/00* (2006.01)

(52) U.S. Cl.
CPC ..... *A47B 47/02* (2013.01); *Y10S 292/68* (2013.01)

(58) Field of Classification Search
CPC ..... E05B 65/025
USPC ..... 292/253, 254, DIG. 68, 80–83, 86, 292/95–98, 100, 121–124, 127, 341.15, 292/341.17, 224, 226, 198, 197, 200; 70/77, 78, 84
See application file for complete search history.

(56) References Cited

U.S. PATENT DOCUMENTS 141,193 A * 7/1873 Adams ..... 70/153
343,348 A * 6/1886 Taylor ..... 292/254
521,366 A * 6/1894 Davis ..... 292/336
529,606 A * 11/1894 Davis ..... 292/198
1,312,160 A * 8/1919 Christy ..... 292/254
1,329,427 A * 2/1920 Otto ..... 52/127.8
1,371,547 A * 3/1921 Burky ..... 292/254
1,662,119 A * 3/1928 Lewis ..... 292/127
1,741,389 A * 12/1929 Wilson ..... 292/254
2,166,735 A * 7/1939 Sward ..... 292/224
2,194,601 A * 3/1940 Kuethe ..... 292/254
2,559,736 A * 7/1951 Scarborough ..... 292/226
2,735,740 A * 2/1956 Soans ..... 312/234
2,754,144 A 7/1956 Timms et al.
2,812,204 A 11/1957 Squire
3,743,336 A 7/1973 Andrews
4,416,413 A 11/1983 Chester
4,554,807 A 11/1985 Dolejs
4,725,084 A * 2/1988 Catricola ..... 292/81
5,802,801 A 9/1998 Hohns et al.
6,431,615 B1 8/2002 Bastian
2010/0154490 A1 6/2010 Hagemeyer et al.

* cited by examiner

*Primary Examiner* — Kristina Fulton
*Assistant Examiner* — Alyson M Merlino
(74) *Attorney, Agent, or Firm* — Caesar, Rivise, Bernstein, Cohen & Pokotilow, Ltd.

(57) ABSTRACT

A storage system including peripheral walls providing a storage area and a pivotally mounted door closing an opening into the storage area. A latching mechanism includes a latch member attached to a peripheral wall cooperating with an inturned latching member on the door to maintain the door closed. The cooperating latch member and inturned latching member extend for more than 25% of the height of the door and most preferably approximately 100% of the height of the door. In another aspect of the invention the latch member and the inturned latching member overlap each other when the door is closed and are forced in a direction to further overlap when a prying force is applied between contiguous surfaces of the door and peripheral wall.

12 Claims, 13 Drawing Sheets

LATCHING SYSTEM FOR STORAGE UNIT

BACKGROUND OF THE INVENTION

1. Field of Invention

This invention relates generally to a latching system for storage units such as lockers, cabinets and similar structures, and more particularly to latching systems for storage units of the type provided with an opening into the unit and including a movable door for opening and closing the opening.

2. Background Art

Storage units, such as lockers and cabinets, most commonly include a door pivotally or hingedly attached at one end thereof to the body of the unit. A latching system is included at the opposite end of the door for maintaining the door in a closed position, when desired. The latching system generally employs a lock to prevent opening of the door until desired.

A common prior art latching system includes a single point latch with an attached lock. In this embodiment the lock is assembled to the door, and latches to the locker body or frame in a single location. This type of single point system requires heavy and/or reinforced doors because of the limited engagement of the locking system over the length or height of the door. However, even when heavy and/or reinforced door structures are employed the door still can be pried open at the single latching point, or alternatively can be bent at the upper and lower corners of the door to provide undesired access to the interior of the storage unit.

Another prior art latching system employs a multipoint hook latch that includes hooks welded to the frame of the storage unit and protruding into the access opening of that unit. A pivotally mounted door is provided with a slide channel assembly including hooks for cooperating with the hooks attached to the frame of the storage unit to thereby secure the door in a closed position. However, the hooks are susceptible to damage and the latch channel in the door can be easily defeated by lifting the latch channel through ventilation or unfilled holes in the door's structure.

In another prior art structure, a hasp is fixed to the frame or body of the storage unit and extends through the door assembly to accommodate a padlock that is directed through the eye of the hasp for securing the door in a locked position. However, this construction also requires the use of a heavy door and the structure still can be defeated by bending the door at the upper and lower corners thereof to provide undesired access to the storage unit.

A further prior art construction includes a multipoint turn handle, which is the most secure of the prior art systems presently being utilized. In this construction a turn handle assembly is provided in the door and is operable to rotate a latch at the center of the locker frame to extend push rods into the top and bottom of the locker frame. Although this provides a strong, locked connection it is a relatively expensive assembly. Moreover, the door can not be "slam shut." Specifically, prior to closing the door the locking mechanism needs to be manually retracted, and after the door is closed the locking mechanism needs to be mechanically actuated to latch the door.

U.S. Pat. No. 2,812,204, issued to Squire, discloses a door retaining latch including a striker engaging portion 30 that normally is spring loaded to extend outwardly into overlying engagement with the surface 56 of a striker attached to the door frame (see FIG. 1). To release the striker engagement portion 30 an L-shaped lever 48 is pivotally mounted for actuation to compress spring 32 and thereby retract striker engaging portion 32 to a position in non-overlapping relationship with striker surface 56.

U.S. Pat. No. 2,754,144, issued to Timms et al., discloses a latching mechanism that generally is intended to be electronically operated through a solenoid member 30.

Other prior art latching systems are disclosed in U.S. Pat. Nos. 4,416,413 (Chester); 6,431,615 (Bastian); 3,743,336 (Andrews) and 4,554,807 (Dolejs).

In addition U.S. Publication No. 2010/0154490 discloses a prior art, high security locking system that is intended to be used in a conventional pivot door adapted for use with a latch and deadbolt lock combination.

Although a variety of different locking or latching systems are employed in storage units, such as lockers, a need exists for an extremely reliable and simple construction that provides enhanced locking action between a pivotally mounted door and an adjacent frame of a storage unit, and which is constructed to defeat the efforts of individuals attempting to pry the door open for the purpose of gaining undesired access to the interior compartment of the storage unit.

SUMMARY OF THE INVENTION

A storage unit in accordance with this invention includes peripheral walls providing a storage area, said peripheral walls including transversely spaced-apart surfaces that provide an opening into the storage area. A door has a front wall and opposed, transversely spaced-apart side walls; each side wall being adjacent or contiguous to a respective transversely spaced-apart surface of a peripheral wall. The door is pivotally mounted to a peripheral wall through a hinged connection adjacent one of the spaced-apart side walls of the door. The hingedly mounted door is moveable about its hinged connection between a closed position overlying and closing the opening into the storage area and an opened position for permitting access to the storage area through said opening. The door has a height substantially equal to the height of the opening into the storage area.

A latching system in accordance with this invention is provided adjacent the transverse side of the door opposed to the side that is pivotally connected to the peripheral wall. The latching system of this invention includes a latch member attached to a peripheral wall adjacent the side of the door opposed to the pivotally connected side, said latch member including a pivotal latch hinge. The pivotal latch hinge includes an inturned segment extending toward and transversely spaced from the peripheral wall to which the latch member is attached for receiving a cooperating latching member of the door. The pivotal latch hinge is normally spring-biased into a position for overlying the latching member of the door to maintain the door in a closed position. The latching member of the door is adjacent the side wall of the door that is opposed to the side wall adjacent the hinged connection and is an in-turned segment of the door disposed in overlying relationship with a front wall of the door and in overlying relationship with the inturned segment of the latch hinge when the door is latched into a closed position. In this construction the cooperative latching action between the inturned segment of the door and the inturned segment of the latch hinge is enhanced when an effort is made to pry the door open with an instrument or tool that is inserted between contiguous surfaces of the door and peripheral wall. The latching system also includes a release mechanism operable to engage the latch hinge and bias the latch hinge about its pivotal connection to a position out of overlying relationship with the latching member of the door to thereby permit the door to be moved into an opened position.

In a preferred embodiment of this invention the latching member of the door extends for substantially the entire height of the door. Most preferably the latching member of the door is a unitary part of the door, being formed as a unitary extension of one of the side walls of the door.

In a preferred embodiment of this invention the pivotal latch hinge, which is secured to the peripheral body of the storage unit, extends for more than 25% of the height of the door for cooperating with the latching member.

More preferably the pivotal latch hinge extends for more than 50% of the height of the door; even more preferably more than 75% of the height of the door and even more preferably more than 90% of the height of the door.

In the most preferred embodiment of this invention the pivotal latch hinge extends for substantially the entire height of the door to thereby provide a locked connection with the latching member of the door over substantially the entire height of the door and the opening into the storage system.

Reference to the latching member of the door extending "for substantially the entire height of said door" means that it extends for at least 90% of the height of the opening into the door, unless otherwise specified.

Other objects and advantages of this invention will become apparent by referring to the description of the drawings which follows taken in conjunction with the detailed description of the preferred embodiments of this invention.

BRIEF DESCRIPTION OF THE DRAWINGS

The invention will be described in conjunction with the following drawings in which like reference numerals designate like elements and wherein.

DESCRIPTION OF THE PREFERRED EMBODIMENTS OF THIS INVENTION

Figure 1:
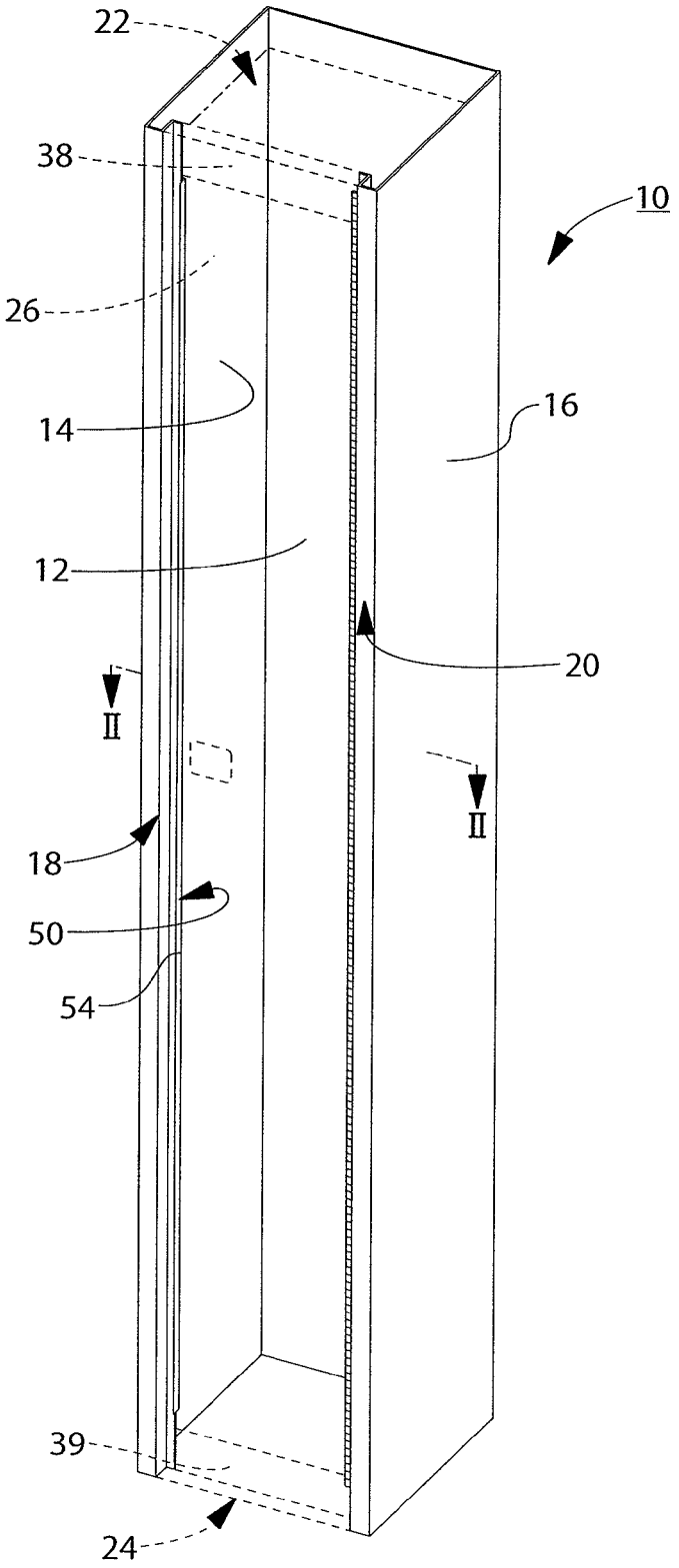
FIG. 1 is an isometric view of a storage unit in accordance with this, invention with the top wall, bottom wall and pivotally mounted door being shown in phantom representation for the purpose of more clearly showing details of construction of a portion of the latching system in accordance with this invention.

Referring to FIG. 1 a storage system in accordance with a preferred embodiment of this invention is illustrated at 10. In the illustrated embodiment the storage system is in the form of a locker. However, it should be understood that the present invention can be employed with various types of storage systems employing a pivotally mounted door for closing a storage area in the system.

Still referring to FIG. 1 the illustrated storage system 10 includes a peripheral back wall 12, peripheral side walls 14 and 16, and front, transversely spaced-apart door jambs 18, 20. The back wall, side walls and door jambs will sometimes be referred to herein as the peripheral body of the storage system.

Still referring to FIG. 1 the storage system 10 also includes a top wall 22, a bottom wall 24 and a pivotally mounted door 26; these latter elements being shown in phantom for the purpose of more clearly illustrating a portion of the latching system in accordance with this invention.

Figure 2:
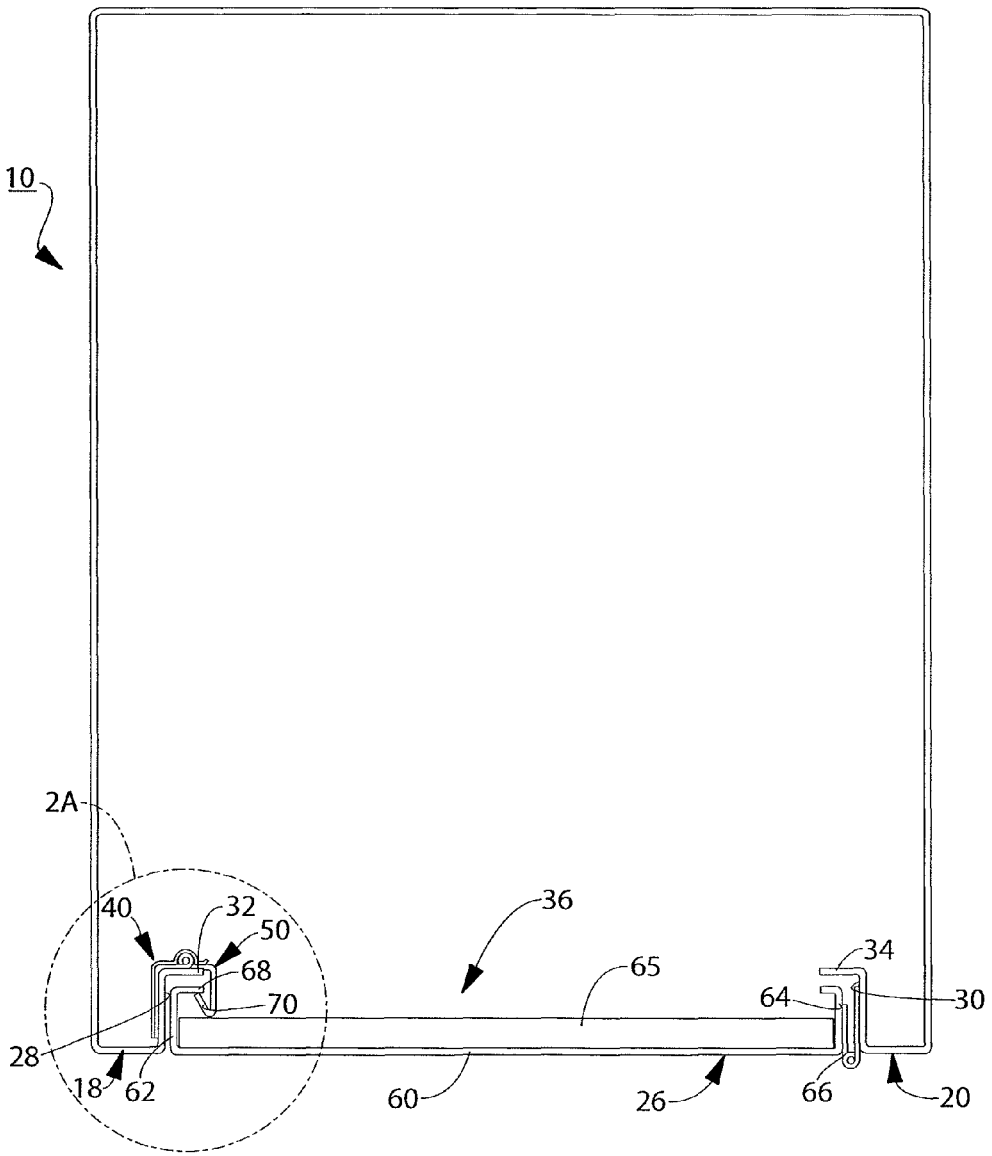
FIG. 2 is a transverse sectional view of the storage unit taken along line II-II of FIG. 1 showing the door of the unit pivotally secured to the peripheral body of the storage unit, with the latching system of this invention in a position for maintaining the door in a closed position; with the latch release mechanism omitted for purposes of clarity.
Figure 2A:
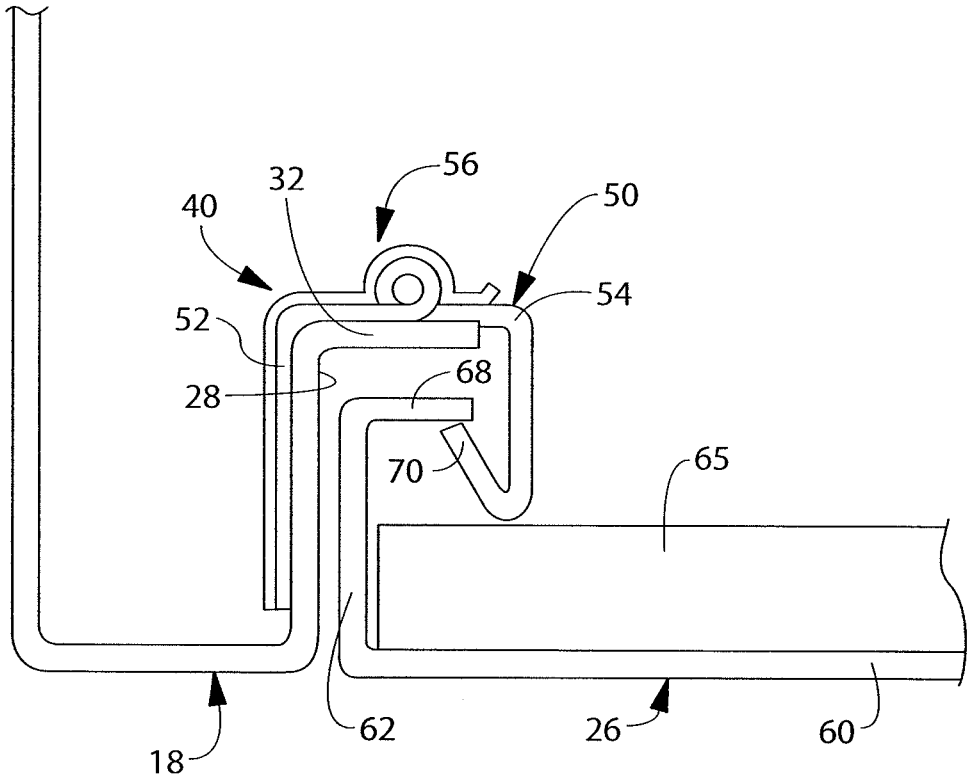
FIG. 2A is an enlarged view of the circled area identified as "2A" in FIG. 2.

Referring to FIGS. 1, 2 and 2A transversely spaced-apart surfaces 28, 30 of the door jambs 18 and 20 face each other and terminate in inwardly extending legs or flanges 32, 34. An opening 36 into the storage area is provided by the spaced-apart door jambs 18, 20 and front walls or skirts 38, 39 of the top and bottom walls 22, 24, respectively. Although the specific structure of the storage unit or locker is not a limitation on the broadest aspects of this invention; a preferred locker construction employing the latching system of this invention is disclosed in copending application Ser. No. 13/187,999, filed on Jul. 21, 2011 and assigned to the owners of the instant application. The subject matter of the '999 application is incorporated herein by reference, in its entirety. In this latter application the door jams are provided by folded over segments of the peripheral walls; thereby providing double-thickness door jam sections.

Referring to FIGS. 1, 2 and 2A, a latching system 40 of this invention includes a latch member 50 as a component thereof. The latch member 50 includes a hinge leg 52 welded or otherwise attached to the door jamb 18, and a pivotal latch hinge 54 that is spring loaded into a latching position or orientation by an external spring 56. The spring 56 is connected to the hinge leg by welding, bonding or any other suitable means, and frictionally engages the upper surface of the pivotal latch hinge 54 to be movable relative to said upper surface.

Referring to FIG. 1, it should be noted that the latch member 50; including the hinge leg 52 and the pivotal latch hinge 54 extends for substantially the full length or height of the opening 36. Specifically, in a preferred embodiment of this invention the latch member 50 has a height which is slightly less than the overall height of the storage system 10. This differential in height between the storage unit and the latch member 50 is compensated for by the height of the front skirts 38, 39 of the top and bottom walls 22 and 24, respectively. In other words, in the fully assembled storage system 10, the latch hinge 54 extends for substantially the same vertical dimension as the vertical dimension of the opening 36 into the storage system.

By way of example only, a standard locker construction has an overall height of 72 inches and the opening into the locker is approximately 70 inches high. This differential of two inches (one inch at each end of the opening) accommodates the front skirts 38, 39 of the top and bottom wall 22 and 24, respectively. In this construction the most preferred height of the pivotal latch hinge 54 is 70 inches; the full height of the opening 36 into the storage unit 10.

Referring to FIGS. 2 and 2A the pivotally mounted door 26 is formed of a sheet metal member and includes a front wall 60, transversely spaced-apart side walls 62 and 64, respectively, inwardly directed top wall (not shown) and an inwardly directed bottom wall 65 of substantially the same dimensions as the top wall.

As can be seen best in FIG. 2 a door hinge 66 of a conventional construction joins surface 30 of door jamb 20 to a contiguous, or adjacent side wall 64 of the door 26.

Still referring to FIGS. 2 and 2A the sheet metal door 26 includes an in-turned latching member 68 formed as a unitary extension of the sidewall 62 of the door, and this in-turned latching member overlies the front wall 60 of the door and in the preferred embodiment extends for the full length of the door.

It also should be noted that the in-turned latching member 68 overlies in-turned segment 70 of the pivotal latch hinge 54 when the door is in a closed position (FIG. 2A).

In view of the fact that both the in-turned segment 70 of the latch hinge 54 and the in-turned latching member 68 of the door most preferably extend for the entire height of the opening 36 into the storage system 10 a cooperative latching action is provided for the full length of the door opening. Most preferably, the segments 70 and 68 are uninterrupted for their entire height; thereby providing continuous, uninterrupted engagement of these latter segments for the entire height of the opening 36. This provides an extremely reliable and continuous latching action; providing a strong bridging, or interconnecting region between the door 26 and the contiguous door jamb 18.

In view of the fact that the interlocking arrangement between the in-turned latching member 68 and the in-turned segment 70 of the latch hinge 54 extends for substantially the full length of the door it is extremely difficult to bend or pry a segment of the door outwardly for the purpose of gaining access to the interior of the storage system 10.

It also should be apparent from FIGS. 2 and 2A that if an attempt is made to pry the door jamb 18 away from side wall 62 of the door by inserting a tool between the side wall and door jamb the force imposed upon both the door 26 and door jamb 18 reinforces the locking action. That is, the in-turned latching member 68 of the door is forced into greater overlying relationship with the in-turned segment 70 of the latch hinge 54.

Figure 3:
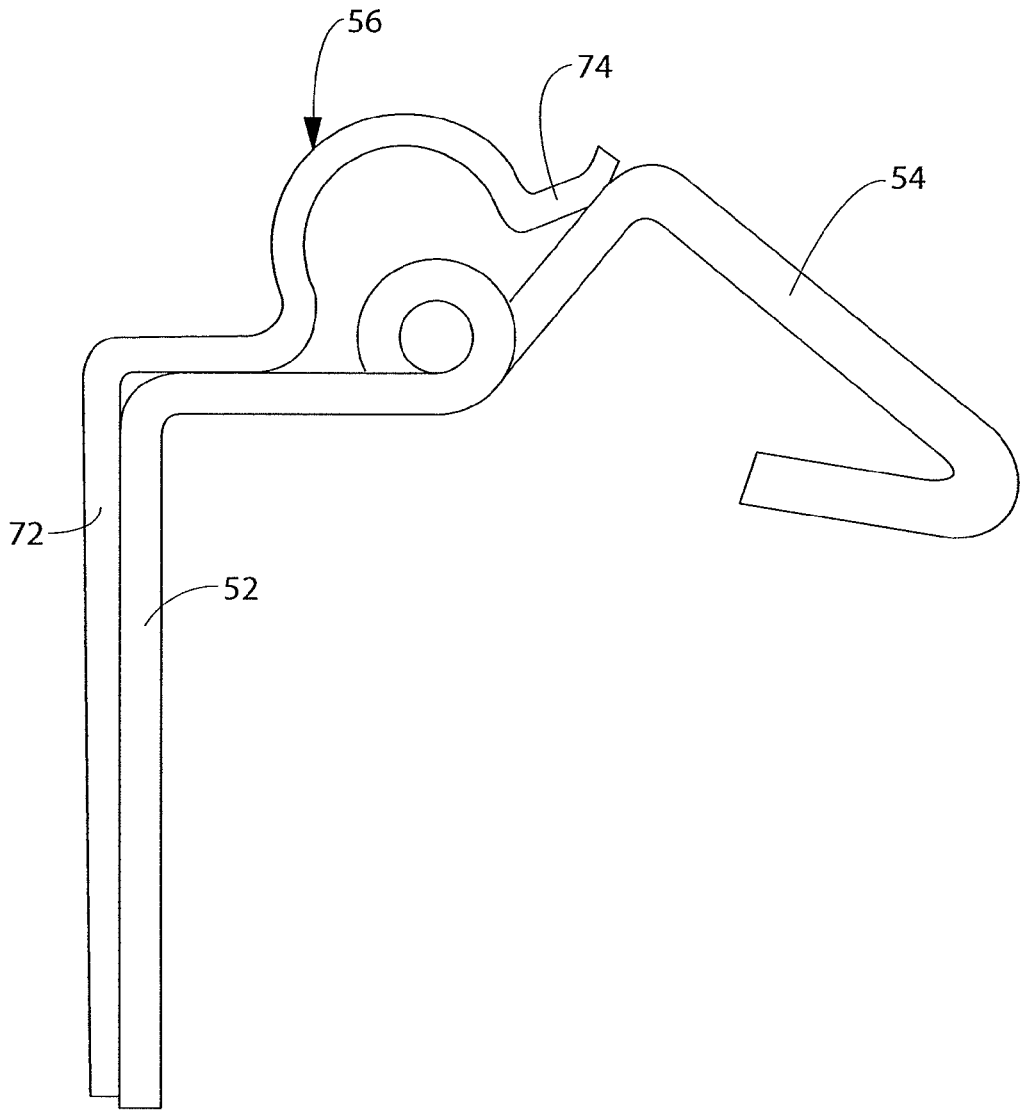
FIG. 3 is an enlarged, end elevational view of a latch member employed in the latching system of this invention including a spring-loaded pivotal latch hinge in an opened condition for permitting the door to be opened.

Referring to FIG. 3 an enlarged view of the spring loaded pivotal latch hinge 54 is illustrated. Specifically, the pivotal latch hinge 54 is spring loaded by external spring 56. The spring 56 includes a leg section 72 permanently secured to hinge leg 52 and includes a section 74 frictionally engaging the upper surface of the pivotal latch hinge to bias, or force, the latch hinge 54 into its latching position. FIG. 3 shows, in a somewhat exaggerated representation, the position of the latch hinge 54 relative to the hinge leg 52 when the latch hinge has been biased into a position to release its engagement with the in-turned latching member 68 of the door 26.

Figure 4:
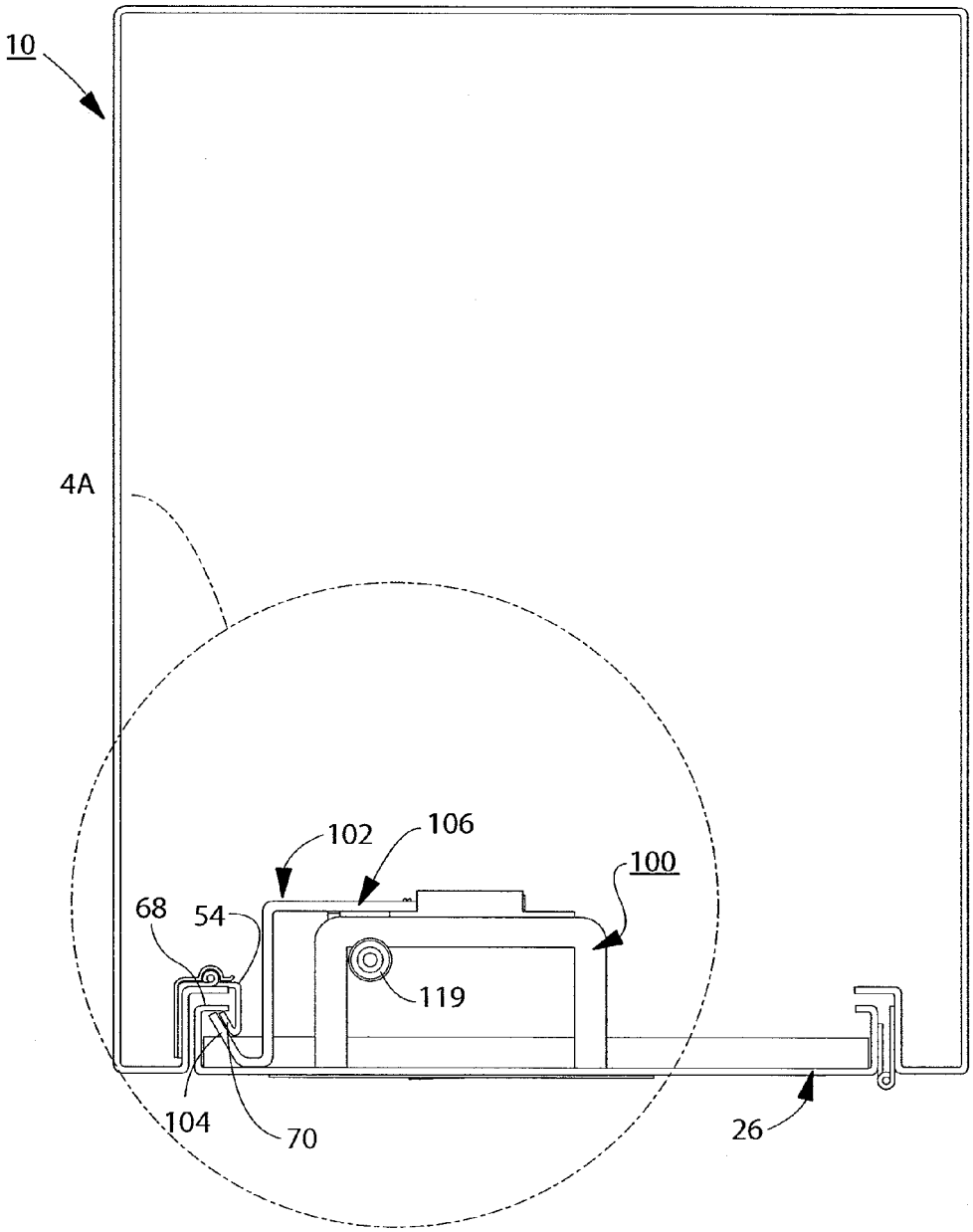
FIG. 4 is a transverse sectional view similar to FIG. 2, but including the latch release mechanism for controlling the operation of the latching system.
Figure 4A:
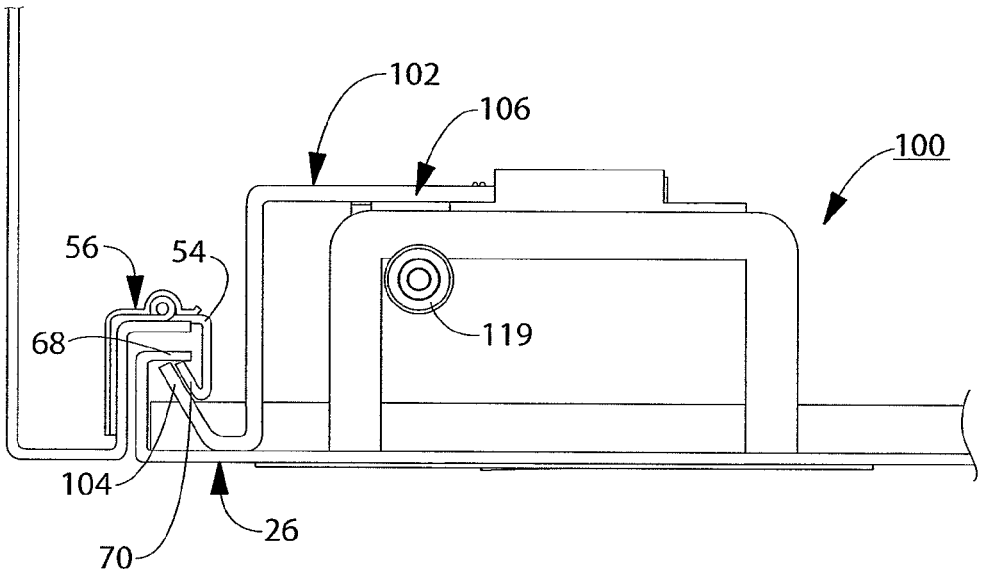
FIG. 4A is an enlarged view of the circled area identified as "4A" in FIG. 4.

Referring to FIGS. 4 and 4A, the storage system 10 is shown with the door 26 in a closed and latched position. In this respect FIGS. 4 and 4A are similar to FIGS. 2 and 2A.

However, FIGS. 4 and 4A shows the door 26 with a latch release mechanism 100 attached thereto. This latch release mechanism was omitted from FIGS. 2 and 2A for purposes of clarity. As shown in FIGS. 4 and 4A, the latch release mechanism is locked in its closed position to maintain the locked condition of the door 26 to the peripheral body of the storage system.

Figure 5:
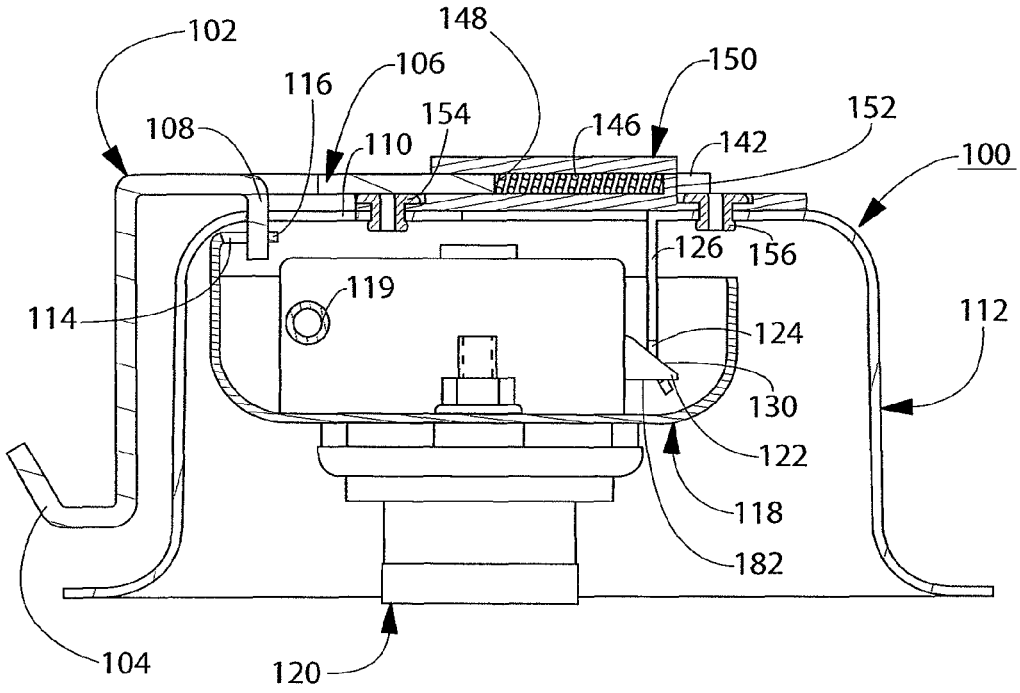
FIG. 5 is a sectional view showing details of construction of the latch release mechanism of this invention when the latching system is engaged to maintain the door in a closed, locked condition as is illustrated in FIGS. 4 and 4A.

Referring to FIGS. 4, 4A and 5 the latch release mechanism 100 includes a latch pull bar 102 having a latch hinge actuating segment 104 adjacent one end thereof. This latch hinge actuating segment 104 overlies in-turned segment 70 of the latch hinge 54. When the latch release mechanism 100 is operated to open the door, the latch pull bar 102 is moved linearly to cause the actuating segment 104 thereof to engage the in-turned segment 70 of the latch hinge 54 and thereby push the latch hinge 54 in a counterclockwise direction out of underlying engagement with the in-turned latching member 68 of the door, to thereby permit the door to be opened about its hinged connection. This opened condition of the latch hinge 54 is illustrated in a somewhat exaggerated view of FIG. 3.

As can be seen most clearly in FIG. 5 the latch pull bar 102 has a linear section 106 including an in-turned, struck-out segment 108 that extends through passage 110 provided in the bottom wall of a cup-shaped retaining member 112 and extends into a passageway 114 in a pull-bar connecting segment 116 of a pivotal paddle or lever 118. It should be noted that the paddle or lever 118 is pivotally mounted about a pivot axle 119 secured at opposed ends thereof within a peripheral wall of the cup-shaped retaining member 112.

Operation of the latch release mechanism 100 will be described in detail hereinafter. However, by way of brief explanation, pivotal movement of the lever or paddle 118 in a clockwise direction about axle 119, as illustrated in FIG. 5, moves the latch pull bar 102 to the right, as viewed in FIG. 5, thereby causing the latch hinge actuating segment 104 of the pull bar to engage and pivot the in-turned segment 70 of latch hinge 54 into a position out of overlying relationship with the in-turned latching member 68 of the door. This permits opening of the door 26 to provide access to the interior compartment or area of the storage system 10.

Referring to FIG. 5, in one preferred embodiment of this invention a combination lock 120 is mounted on an upper wall of the paddle or lever 118 and includes a locking bolt 122 as part of its construction. This locking bolt 122 is retained within a locking passage 124 of a strike 126, which is struck out of the bottom wall of the cup-shaped retaining member 112.

Still referring to FIG. 5, the locking bolt 122 includes an inclined inner surface 130 that is adapted to ride along the strike 126 as the door is being closed, until the locking bolt 122 aligns with the locking passage 124. At that time the locking bolt, which normally is biased outwardly, moves into the locking passage 124 to thereby lock the paddle or lever 118 in a closed position and with the latching system in a closed condition. It should be noted that the surface of the bolt 122 opposite inclined surface 130 is a flat surface 132 that precludes the bolt from being forced inwardly to disengage from the locking passage 124 in the event that a user attempts to pivot the paddle or lever 118 in a clockwise direction, as viewed in FIG. 5, without first opening the combination lock.

In use, the combination lock is actuated by turning it through its desired combination settings; the final setting functioning to retract the locking bolt 122 from its engagement within the locking passage 124 of the strike 126.

Figure 8:
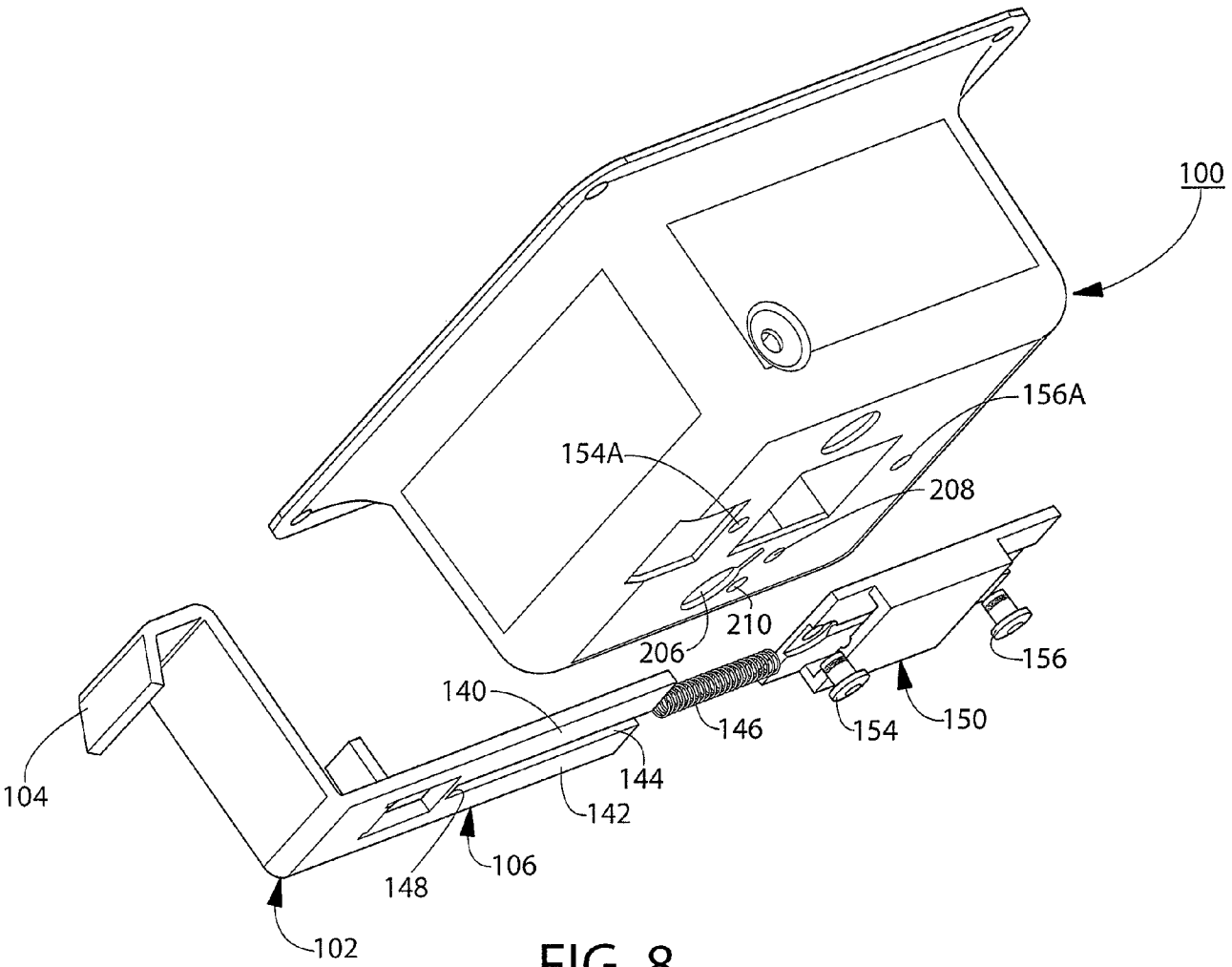
FIG. 8 is an exploded isometric view of elements of the latch release mechanism showing details of construction.

Referring to FIGS. 5 and 8 it should be noted that the linear section 106 of the pull bar includes spaced-apart leg sections 140, 142. The spaced-apart leg sections provide an elongate slot 144 in which a compression spring 146 is received. It should be noted that the compression spring 146 is pushed into the slot 144 until an end thereof engages base 148 of said slot. The spaced-apart leg sections 140 and 142 and the compression spring 146 included within the slot 144 are received within latch pull bar slide 150.

The latch pull bar slide 150 has a rear wall 152 with spaced-apart passages therein through which legs 140, 142 of the linear segment 106 of the latch pull bar 102 is received.

As can be seen in FIG. 5 the compression spring is in a compressed, loaded condition between the base 148 of the slot 144 and rear wall 152 of the latch pull bar slide 150.

Still referring to FIGS. 5 and 8 the pull bar slide 150 is attached to the base of the cup-shaped retaining member 112 by rivets 154, 156 or other suitable fastening means. As can be seen in FIG. 8 these rivets 154, 156 are received within aligned passages 154A, 156A in the bottom wall of the cup-shaped retainer of 112.

Still referring to FIG. 8, it should be noted that the latch pull bar 102, including the segment 104 that engages the in-turned segment 70 of the latch hinge 54 only engages the in-turned segment 70 over a very limited portion of the length of the latch hinge 54 in order to provide its retracting function. In an illustrative embodiment, in a locker in which the latch hinge 54 is approximately 70 inches high the height of the latch pull bar (i.e., the transverse dimension thereof) is approximately one (1) inch. Although the specific dimension of the latch pull bar does not provide a limitation on the broadest aspects of this invention, the need for a pull bar having only a minimal height simplifies the overall construction of the latch release mechanism 100.

Figure 6:
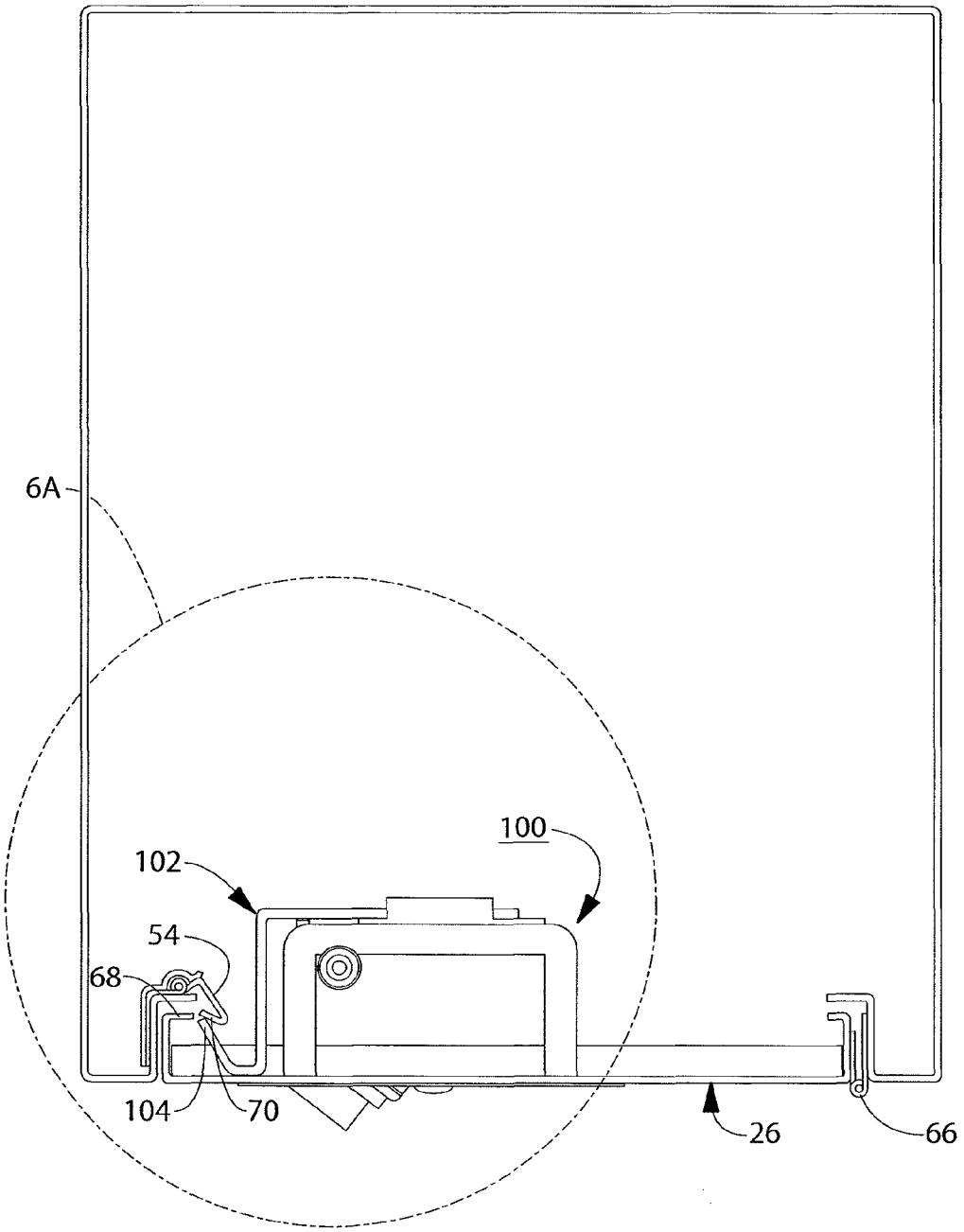
FIG. 6 is a transverse sectional view similar to FIG. 4 but showing the latch release mechanism in a position for releasing the interlocking engagement between the pivotal latch hinge of the latch member attached to the peripheral body and the in-turned latching member of the door to thereby permit the door to moved into an opened position.
Figure 6A:
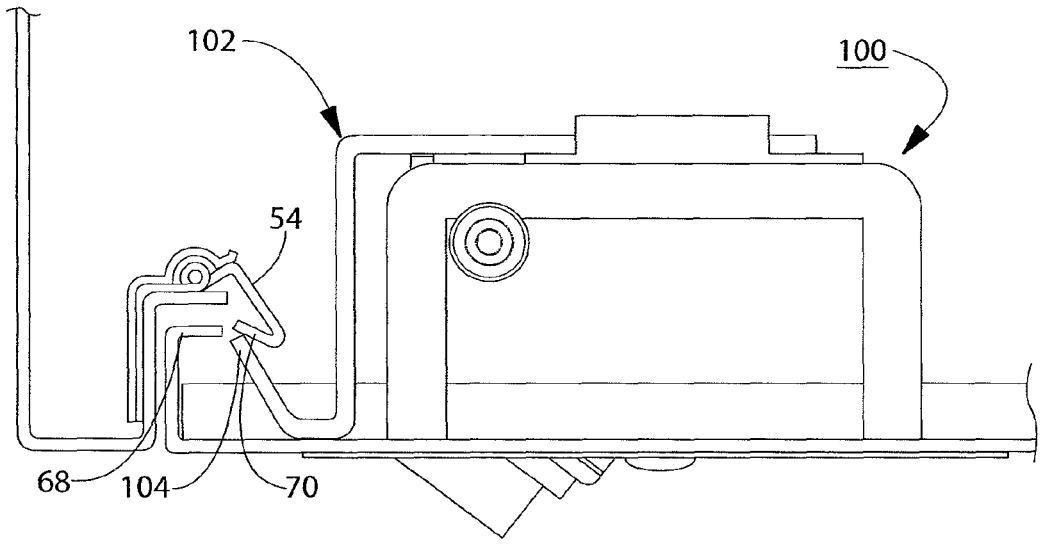
FIG. 6A is an enlarged view of the circled area identified as "6A" in FIG. 6.
Figure 7:
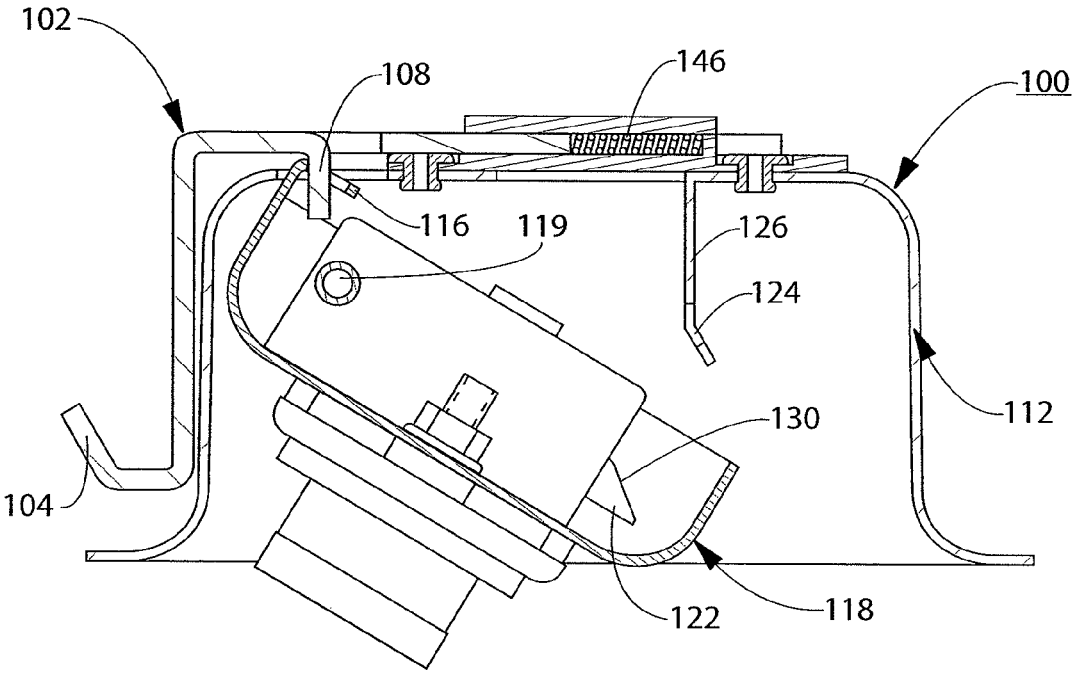
FIG. 7 is a sectional view of the latch release mechanism showing the position of the various elements thereof when the lever or paddle has been moved into a position for disengaging the latching action of the latching system.

Referring to FIGS. 6, 6A and 7 the arrangement and operation of components for releasing the latching, or locking action between the pivotal latch hinge 54 and overlying, in-turned latching member 68 is illustrated. First, the combination lock is operated to retract the locking bolt 122 from its engagement within the locking passage 124 of the strike 126. Thereafter, the paddle or lever 118 is engaged by an individual and rotated about the pivotal axle 119 into the position that is most clearly visible in FIG. 7. As a result of this pivotal movement the pull bar connecting segment 116 of the paddle rotates to positively engage the in-turned, struck-out segment 108 of the pull bar and thereby retract the pull bar (i.e., moves the pull bar to the right as illustrated in FIG. 7) against the opposing force of compression spring 146.

The above-described retraction of the pull bar 102 causes segment 104 thereof to engage the in-turned segment 70 of the latch hinge 54 and thereby force the latch hinge out of overlying relationship with the in-turned latching member 68 provided by the door 26. This opened condition between the latch hinge 54 and the latching member 68 is clearly shown in FIGS. 6 and 6A, thereby permitting the door to be pivotally opened by the movement about the door hinge 66. In this position the latch release mechanism 100 is in the position illustrated in FIGS. 6, 6A and 7.

Referring to FIG. 7, it should be noted that once the door 26 is in an open position the paddle or lever 118 can be rotated in a counterclockwise direction, as viewed in FIG. 7, into a position wherein the inclined surface 130 of bolt 122 rides along the strike 126 until the bolt is aligned with and engages within the locking passage 124 of the strike. In this position the latch hinge actuating segment 104 of the latch pull bar 102 is returned to the position illustrated in FIGS. 4, 4A and 5, and the spring loaded pivotal latch hinge 54 will be returned to its position illustrated in FIGS. 4 and 4A.

It should be noted that when the paddle or lever 118 is released the compressed spring 146 causes, or forces, the pull bar back into its extended position, which results in the rotation of the paddle or lever 118 back to its closed position. This occurs automatically when the opening force on the paddle or lever 118 is removed. In this condition, when the door is slam shut the inturned latching member 68 of the door rides against the inturned segment 70 of the latch hinge 54; biasing the latch hinge outwardly until the latching member 68 clears the inturned segment 70 when the door is fully closed. In this position the spring action on the latch hinge 54 forces the inturned segment 70 thereof into underlying, latching engagement with the latching member 68. Thus, in this invention the door can automatically be slammed into a closed, latched condition without requiring the manual, mechanical manipulation of any of the locking members.

It should be noted that movement of the paddle or lever 118 in a counterclockwise direction causes the pull bar connecting segment 116 of the paddle or lever to engage the in-turned struck out segment 108 of the linear segment of 106 of the latch pull bar 102 and aid in, moving the pull bar 102 into the position shown in FIGS. 4, 4A and 5. This movement will take place even if the compression spring 146 should fail.

When the door 26 is then moved into a position to close the opening into the storage area with the paddle or lever 118 in a closed position the distal surface of the in-turned latching member 68 of the door engages the inturned segment 70 of the pivotal latch hinge 54 and forces it to the right, as illustrated in FIG. 4A, until the in-turned latching member 68 clears the distal edge of the inturned segment 70. At that point the door will be in a closed position and the external spring 56 forces the pivotal latch hinge 54 in a clockwise direct as viewed in FIG. 4 into a position underlying the in-turned latching member 68 of the door 26.

Figure 9:
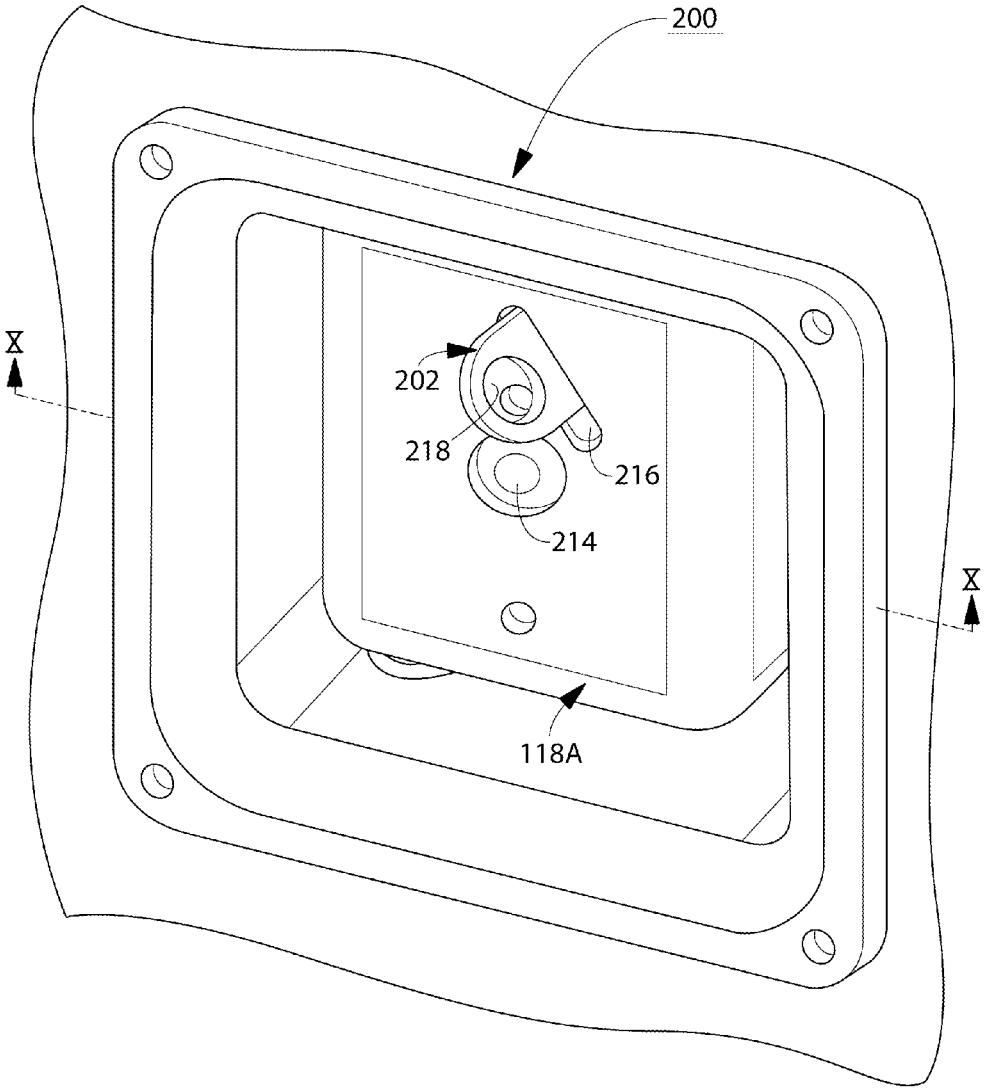
FIG. 9 is an isometric view of the front of an additional embodiment of a latch release mechanism, showing the manner in which a staple thereof extends through the actuating paddle or lever for receiving a lock to thereby prevent actuation of the lever to release the locking action of the latching system.
Figure 10:
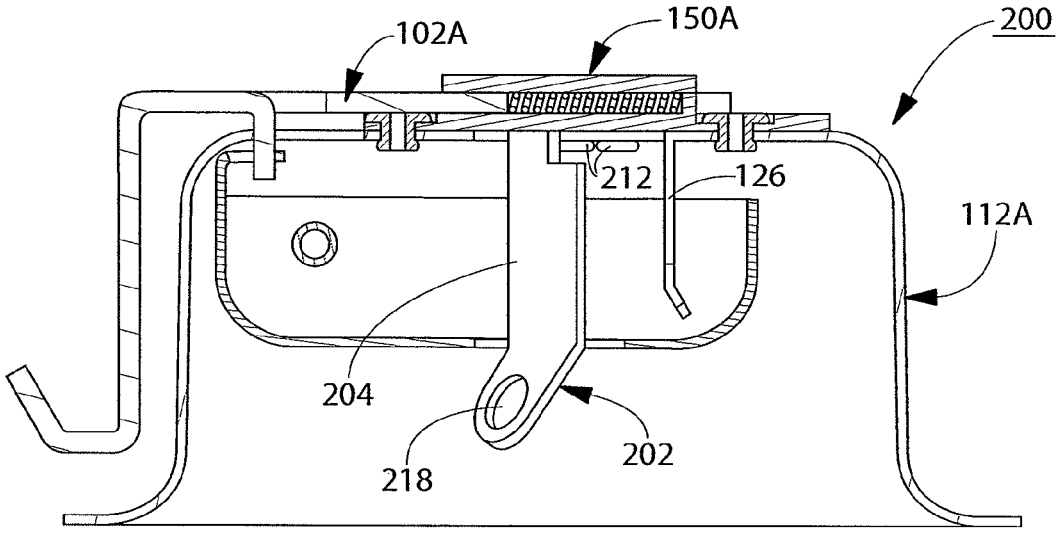
FIG. 10 is a sectional view through the actuating member along line X-X in FIG. 9 illustrating the orientation of various elements of the latch release mechanism in accordance with this embodiment of the invention.

Referring to FIGS. 9 and 10 an alternative construction of a lock release mechanism in accordance with this invention is illustrated at 200. Elements that are the same or similar to the elements described above in connection with the embodiment employing a combination lock are referred to by the same number, but with a suffix "A". The lock release mechanism 200, unlike the mechanism 100 is constructed to receive, or employ a padlock to retain the door of the storage unit in a locked and latched condition.

Referring specifically to FIG. 10, it should be noted that a latch pull bar 102A is identical to the latch pull bar 102 and is mounted within a latch pull bar slide 150A that is identical to the latch pull bar slide 150. Thus, for, purposes of brevity a discussion of these common features will not be repeated herein.

One of the differences between the previously disclosed embodiment of the lock release mechanism 100 employing a combination lock and the embodiment of the lock release mechanism 200 illustrated in FIGS. 9 and 10 is that the cup-shaped retaining member 112A is provided with a staple 202 having a stem 204 extending into the interior thereof. The staple 202 includes a passage 218 through the distal end for receiving a padlock therethrough. The staple 202 is inserted into the cup-shaped retaining member 112A from the outside of that member, through passage 206 (FIG. 8). The base of the stem 204 includes a transversely extending flange (not shown) having openings that align with passages 208, 210 in the base of the cup-shaped member 112A (see FIG. 8). The openings in the flange are adapted to receive either pop rivets 212, screws or other similar fastening means, to thereby secure the staple 202 into its proper position.

As is shown in FIG. 10, the in-turned strike 126 can still be included in the configuration of the cup-shaped retaining member 112A to thereby give the purchaser of the storage unit the option of employing a combination lock in conjunction with the latching mechanism. In fact, as can be seen in FIG. 9, the paddle or lever 118A is provided with a mounting opening 214 for receiving a combination lock assembly if the purchaser desires to employ such an assembly in the storage system.

Referring to FIGS. 9 and 10 it can be seen that the staple 202 passes through an opening 216 in the upper wall of the paddle or lever 118A and the portion of the staple extending through that wall includes a passage 218 through which a combination lock or other padlock can be secured. By securing a padlock through this passage the outward movement of the paddle or lever 118A is precluded, to thereby prevent the undesired opening of the storage area by the outward movement of the paddle 118A about its pivotal connection.

While the invention has been described in detail and with reference to specific examples thereof, it will be apparent to one skilled in the art that various changes and modifications can be made therein without departing from the spirit and scope thereof.

For example, although in the most preferred embodiment of this invention the pivotal latch hinge 54 and cooperating, in-turned latching member 68 of the door extend for substantially the full length or height of the door opening, it is within the broad scope of this invention for the cooperating latching members to extend for a distance less than the full height of the opening. For example, in accordance with the broadest aspects of this invention the pivotal latch hinge 54 and cooperating in-turned latching member 68 should engage each other for at least 25% of the height of the door; more preferably 75% of the height of the opening; even more preferably over 90% of the height of the opening and most preferably approximately 100% of the height of the opening.

What we claim as our invention is the following:

1. A storage system including peripheral walls providing a storage area, said peripheral walls including transversely spaced-apart surfaces providing an opening into said storage area, a door having a front wall and opposed, first and second transversely spaced-apart side walls, said door being hingedly mounted to a first one of said peripheral walls adjacent said first spaced-apart side wall of said door for movement between a closed position overlying and closing said opening into said storage area and an open position for permitting access to said storage area through said opening, said door having a height substantially equal to the height of the opening into said storage area;

A. a latching system adjacent the second spaced-apart side wall of said door for maintaining said door in said closed position and being releasable to permit said door to be moved into said open position, said latching system including:

(1) a latch member including a pivotal latch hinge, said latch member being retained on a second one of said peripheral walls adjacent the second spaced-apart side wall of the door, said pivotal latch hinge including a pivotal segment including an in-turned segment at a distal end thereof, said in-turned segment extending from said distal end of said pivotal segment in a direction away from the opening into said storage area and inclined toward a contiguous, transversely spaced-apart surface of said second one of said peripheral walls, said distal end of said in-turned segment being transversely spaced from said contiguous, transversely spaced-apart surface of said second one of said peripheral walls for providing a space for receiving therein a cooperating latching member of said door for maintaining said door in said closed position, said pivotal latch hinge being normally biased into a position wherein said in-turned segment overlaps the latching member of said door to maintain said door in said closed position when the cooperating latching member of said door is in said space;

(2) said latching member of said door being contiguous to the second spaced-apart side wall of said door, said latching member being an in-turned segment extending from said second spaced-apart side wall of said door in a direction toward said first spaced-apart side wall of said door and terminating in a distal end, said latching member of said door being in overlying, spaced relationship with said front wall of said door for permitting said in-turned segment of said pivotal latch hinge to be located in a position between said latching member of said door and said front wall of said door in overlapping relationship with said latching member of said door when said door is latched in said closed position;

whereby said latching action is enhanced by imposing a force in a direction to enhance the overlap between said latching member and said in-turned segment of said pivotal latch hinge when an effort is made to pry the door open with an instrument or tool being inserted between contiguous surfaces of said second one of said peripheral walls of the storage system and the second spaced-apart side wall of the door; and B. a release mechanism including a latch hinge actuating segment operable to engage the pivotal latch hinge and bias said latch hinge out of overlapping relationship with the latching member of said door to thereby permit the door to be moved into said open position.

2. The storage system of claim 1, wherein said latching member of said door extends for substantially the entire height of said door.

3. The storage system of claim 1, wherein said latching member of said door is a unitary part of said door being formed as a unitary extension of said second spaced-apart side walls.

4. The storage system of claim 1, wherein said latching member of said door extends for substantially the entire height of said door and said pivotal latch hinge extends for more than 25% of the height of said door.

5. The storage system of claim 1, wherein said latching member of said door extends for substantially the entire height of said door and said pivotal latch hinge extends for more than 50% of the height of said door.

6. The storage system of claim 1, wherein said latching member of said door extends for substantially the entire height of said door and said pivotal latch hinge extends for more than 75% of the height of said door.

7. The storage system of claim 1, wherein said latching member of said door extends for substantially the entire height of said door and said pivotal latch hinge extends for more than 90% of the height of said door.

8. A storage system including peripheral walls providing a storage area, said peripheral walls including transversely spaced-apart surfaces providing an opening into said storage area, a door having a front wall and opposed, first and second transversely spaced-apart side walls, said door being hingedly mounted to a first one of said peripheral walls adjacent said first spaced-apart side wall for movement between a closed position overlying and closing said opening into said storage area and an open position for permitting access to said storage area through said opening, said door having a height substantially equal to the height of the opening into said storage area;

A. a latching system adjacent the second spaced-apart side wall of said door for maintaining said door in said closed position and being releasable to permit said door to be moved into said open position, said latching system including:

(1) a latch member including a pivotal latch hinge extending for more than 25% of the height of said door, said latch member being retained on a second one of said peripheral walls adjacent the second spaced-apart side wall of said door, said pivotal latch hinge including a pivotal segment including an in-turned segment at a distal end thereof for receiving a cooperating latching member of said door, said distal end of said in-turned segment being spaced from the second one of said peripheral walls to provide a space between said distal end of said in-turned segment and the second one of said peripheral walls for receiving said latching member of said door therein, said pivotal latch hinge being normally biased into a position in which said in-turned segment overlies the latching member of said door when said latching member of said door is in said space between said distal end of said in-turned segment and the second one of said peripheral walls to maintain said door in said closed position;

(2) said latching member of said door being a continuous, unitary extension of the second spaced-apart side wall of said door, said latching member extending from the second spaced-apart side wall in a direction toward the first spaced-apart side wall and being in overlying relationship with said front wall of said door, said latching member of said door being spaced inwardly from said front wall of said door to provide a space between said front wall and latching member of said door for receiving the in-turned segment of said pivotal latch hinge with said in-turned segment underlying and overlapping the latching member when said door is latched in said closed position, said latching member having a length substantially equal to the entire height of the door;

B. a release mechanism including a latch hinge actuating segment operable to engage the pivotal latch hinge and bias said in-turned segment of said latch hinge out of underlying and overlapping relationship with the latching member of said door to thereby permit the door to be moved into said open position.

9. The storage system of claim 1, wherein said pivotal latch hinge extends for more than 50% of the height of said door.

10. The storage system of claim 1, wherein said pivotal latch hinge extends for more than 75% of the height of said door.

11. The storage system of claim 1, wherein said pivotal latch hinge extends for more than 90% of the height of said door.

12. The storage system of claim 1, wherein said pivotal latch hinge extends for substantially the entire height of the opening into the storage area.

* * * * *